United States Patent [19]

Martin

[11] 4,093,008

[45] June 6, 1978

[54] SCREW DRIVER HAVING CAPPED HANDLE WITH ROTABLE CAP

[76] Inventor: Lino Martin, 2659 W. Okeechobe Rd., Hialeah, Fla. 33010

[21] Appl. No.: 779,594

[22] Filed: Mar. 21, 1977

Related U.S. Application Data

[63] Continuation of Ser. No. 625,364, Oct. 24, 1975, abandoned.

[51] Int. Cl.[2] ..... B25G 1/00

[52] U.S. Cl. ..... 145/61 EA; 145/61 G

[58] Field of Search ..... 145/61 EA, 61 E, 50 R, 145/50 B, 61 G

[56] References Cited

U.S. PATENT DOCUMENTS

| | | | |
|---|---|---|---|
| 89,755 | 5/1869 | Foster | 145/61 G |
| 687,401 | 11/1901 | Morse | 145/61 EA |
| 796,201 | 8/1905 | Frampton | 145/61 G |
| 814,318 | 3/1906 | Peck | 145/61 G |
| 861,010 | 7/1907 | Zeman | 145/61 EA |
| 1,127,007 | 2/1915 | Jennings | 145/61 G |
| 1,530,905 | 3/1925 | Nance | 145/61 EA |
| 2,324,839 | 7/1943 | Haumerson | 145/50 R |
| 2,564,356 | 8/1951 | Dianda | 145/61 E |
| 2,775,276 | 12/1956 | Rossner | 145/61 EA |
| 2,849,041 | 8/1958 | Vetri | 145/61 EA |

*Primary Examiner*—James L. Jones, Jr.
*Assistant Examiner*—J. T. Zatarga

[57] ABSTRACT

A tool having a tool carrying shaft fixed to a handle portion which is sized to fit the hand of a user for rotating the tool and with an end cap portion which is rotatably journaled on the proximal end of the tool so that a large axial force can be applied to the tool without causing frictional resistance to turning of the handle portion to apply torque.

2 Claims, 4 Drawing Figures

SCREW DRIVER HAVING CAPPED HANDLE WITH ROTABLE CAP

This application is a continuation of Ser. No. 625,364, filed Oct. 24, 1975, now abandoned.

FIELD OF THE INVENTION

This invention relates to hand-held tools and, more particularly, to a hand-held tool with a handle portion which is fixed to a shaft for use in rotating the working end of the tool and a proximal end cap which is rotatably journaled on the shaft, so that an axial pressure can be applied without causing friction to rotation of the tool.

BACKGROUND OF THE INVENTION

As is perhaps well known, it is often required, simultaneously, to apply a large axial force to a tool and to apply torque or a rotating force, as when using a screwdriver to withdraw a threaded screw from a threaded bore. The result is that the axial force applied by the hand of a user causes a large amount of friction which must be overcome in addition to the force required to threadably withdraw a screw.

This invention has as an object the provision of a hand-held tool which includes a handle portion sized to fit the hand of a user which is in the order of 4 to 8 inches in axial length and which is fixed to a tool carrying shaft extending axially from the handle portion and which, also, includes an end cap rotatably journaled to the proximal end of the tool with bearing means interconnecting the handle portion and the end cap, so that a large axial force may be applied to the end cap of the tool without causing large amounts of friction which must be overcome by rotating the tool utilizing the handle portion.

It is a general object of this invention to provide an improved screwdriver which is highly useful in those situations where a relatively large amount of axial force must be applied to the tool which must be rotated simultaneously and which includes bearing means interconnecting a handle portion sized to fit the hand of a user and an end cap, which bearing includes anti-friction means.

In accordance with these and other objects which will become apparent hereinafter, the instant invention will now be described with reference to the accompanying drawings in which:

DESCRIPTION OF THE PREFERRED EMBODIMENT

Figure 1:
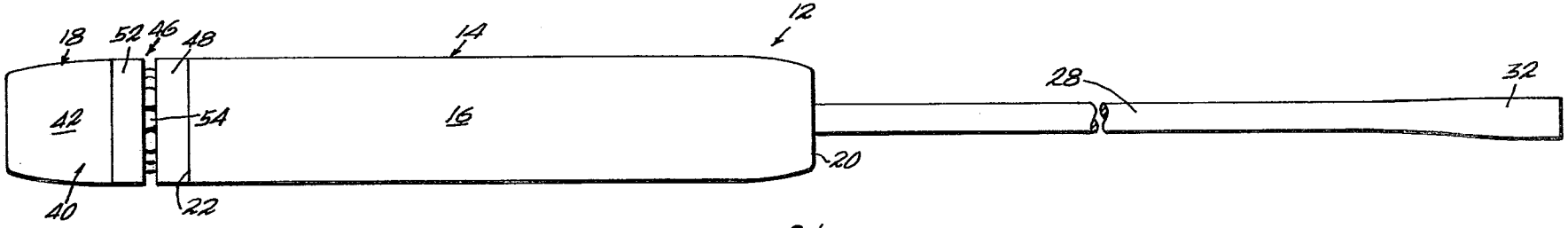
FIG. 1 is a side view of a tool constructed in accordance with this invention.
Figure 2:
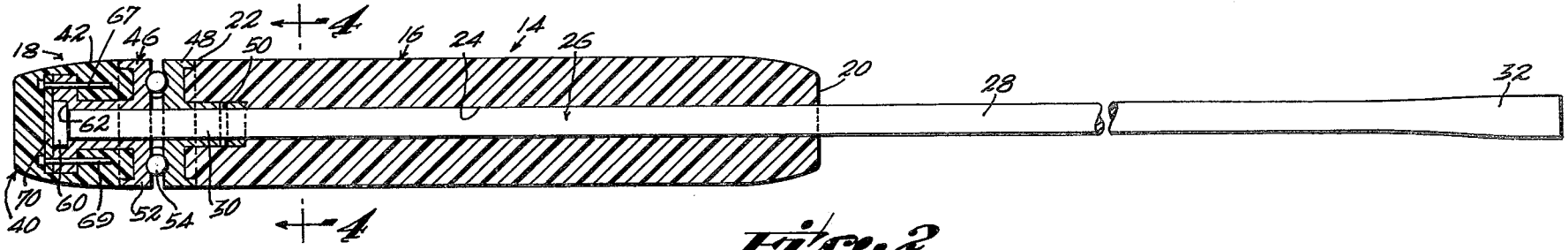
FIG. 2 is a view in cross section of FIG. 1.
Figure 4:
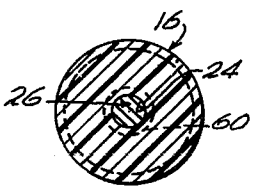
FIG. 4 is a view in cross section taken on the plane indicated by the line 4—4 of FIG 1 and looking in the direction of the arrows.
Figure 3:
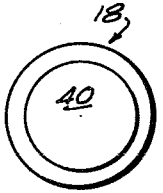
FIG. 3 is a left side end view of FIG. 1.

Referring to the drawings wherein like reference characters designate like or corresponding parts throughout the several views and referring particularly to FIG. 1, the numeral 12 generally designates a tool which includes an elongate handle 14 which comprises a main handle portion 16 and an end piece 18. The main handle portion 16 has a distal end 20 and a proximal end 22 and is provided with a through axial bore 24. In the preferred embodiment, a shaft 26 extends through the handle bore 24 with a distally extending shaft portion 28 and a proximally extending shaft portion 30. A tool, such as a screwdriver head 32, is provided on the distal end of the shaft 26. While a single or continuous shaft is illustrated, for purposes of this description the shaft may be considered as being composed of a distal shaft portion 28 and a proximal shaft portion 30 which are fixed to the main handle portion and extend axially oppositely outwardly from the main handle portion and are fixed to the main handle portion for rotation therewith about the longitudinal centerline of the tool, i.e., as a unit.

The means for fixing the main handle portion and the shaft are conventional and may include strong adhesive means or, if desired, a lateral pin, not shown, through the shaft and handle portion. On the proximal end of the proximal shaft portion 30, an end piece 40 is captivated against axial movement and rotatably journaled to the proximal shaft portion, as will now be described. The end cap comprises a body 42, in the nature of a knob, which is connected to the shaft by a bearing generally designated by the numeral 46. The bearing includes a portion 48 fitted on the proximal end of the main handle portion and fixed, as by the pin 50, to the shaft; and a portion 52 fitted on the distal end of the end cap and rotatable on the shaft while being captivated in a predetermined axial position on the shaft. Ball bearing means 54 are captivated by the confronting faces of the bearing. The means for axially positioning the end cap and captivating it on the proximal shaft portion comprise an enlarged head 60 on the proximal end of the shaft which presents a distally facing shoulder 62 confronting an abutment surface on the bearing portion 52 and pins 67 and 69 which fix an end plate 70 to the bearing piece 52 and end piece 18. The headed shaft end and shaft are free to rotate in the space thus defined while being effectively captivated at a predetermined axial position. A peripheral skirt, not shown, may be provided on the bearing portions to shield the race in the faces of the confronting bearing portions against entry of grit, grime and dirt for ease of operation over extended lengths of time.

In use, the working end of the tool is engaged in a screw, for example, and an operator may apply an axial force of substantial magnitude on the end piece directed toward the tool end and, notwithstanding this force, apply torque to the main handle portion and tool to unscrew a bolt. In other words, the end cap provides means for transmitting axial force without creating substantial friction so that the main handle portion may be rotated to apply torque.

I claim:

1. A tool comprising:

A. an elongate cylindrical handle with an axial through bore and having a first end zone and a second end zone, said handle being sized to fit the hand of a user, B. a shaft having a first end zone, a second end zone and an intermediate zone, said intermediate zone being between the end zones, and said second end zone comprising a working end of the tool, C. means to fix the intermediate zone of the shaft in the bore of the handle for rotation of said handle and said shaft as a unit about the longitudinal centerline of the handle and shaft, D. said first end zone extending from said handle, E. an end cap on said extending first end zone including means to captivate said end cap on said extending end zone in a fixed axial position in which it is rotatable on said first end zone and means rotatably journalling said end cap on said first end zone, F. said end cap having a bearing therewithin with an axial face facing said handle and said handle having a bearing therewithin with an axial face facing said end cap and ball bearing means captivated between said bearing faces;

G. said means to captivate said end cap on said extending shaft portion comprising a headed end on the first end zone of said shaft, said headed end being of a larger diameter than the remainder of the shaft and defining an axially facing abutment shoulder when viewed from the working end of the tool and a flat bearing surface when viewed from the end cap end of the tool, said end cap bearing having an axial bore for accommodating said first end zone of said shaft and being shaped with two end portions of larger diameter than the middle portion, one large diameter portion defining said axial face facing said handle, the other opposite large diameter portion having a cylindrical recess surrounding said headed end of said shaft, the bottom of the recess defining a shoulder for bearing against said abutment shoulder of said headed end of said shaft, an end plate between said end cap and said headed end of said shaft and bearing against said flat bearing surface of said headed end, and pin means fixing said end plate to the said other opposite large diameter portion of said end cap bearing, the end cap filling in the area between the two larger diameter end portions of the end cap bearing and being held to said bearing by said pin means.

2. The device of claim 1 wherein the second end zone of the handle is tapered longitudinally providing a smooth gripping handle surface.

* * * * *